US008465895B2

(12) United States Patent
Ikeda et al.

(10) Patent No.: US 8,465,895 B2
(45) Date of Patent: Jun. 18, 2013

(54) ELECTROSTATIC IMAGE DEVELOPING TONER, ELECTROSTATIC IMAGE DEVELOPER, TONER CARTRIDGE, PROCESS CARTRIDGE, IMAGE FORMING METHOD, AND IMAGE FORMING APPARATUS

(75) Inventors: Yusuke Ikeda, Kanagawa (JP); Yukiaki Nakamura, Kanagawa (JP); Kiyohiro Yamanaka, Kanagawa (JP); Satoshi Kamiwaki, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 187 days.

(21) Appl. No.: 13/106,332

(22) Filed: May 12, 2011

(65) Prior Publication Data

US 2012/0148948 A1 Jun. 14, 2012

(30) Foreign Application Priority Data

Dec. 13, 2010 (JP) ..... 2010-276962

(51) Int. Cl.
*G03G 9/08* (2006.01)

(52) U.S. Cl.
USPC ..... 430/108.6; 430/108.1

(58) Field of Classification Search
USPC ..... 430/106.6, 108.1
See application file for complete search history.

(56) References Cited

U.S. PATENT DOCUMENTS 6,114,077 A 9/2000 Voets et al.
2004/0137349 A1 * 7/2004 Horikoshi et al. ..... 430/108.6

FOREIGN PATENT DOCUMENTS

JP A-08-339095 12/1996
JP A-2000-056514 2/2000

* cited by examiner

*Primary Examiner* — Hoa V Le
(74) *Attorney, Agent, or Firm* — Oliff & Berridge, PLC

(57) ABSTRACT

An electrostatic image developing toner contains a binder resin and at least two different kinds of white pigments, wherein from about 10% by weight to about 30% by weight of the at least two kinds of white pigments is porous titanium oxide having a volume average particle diameter of from about 0.01 μm to about 1 μm, a particle size distribution (volume average particle size distribution index GSDv) of from 1.1 to 1.3 and a BET specific surface area of from about 250 $m^2/g$ to about 500 $m^2/g$.

23 Claims, No Drawings

ELECTROSTATIC IMAGE DEVELOPING TONER, ELECTROSTATIC IMAGE DEVELOPER, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2010-276962 filed on Dec. 13, 2010.

BACKGROUND

1. Technical Field

The present invention relates to an electrostatic image developing toner, an electrostatic image developer, a toner cartridge, a process cartridge, an image forming method and an image forming apparatus.

2. Related Art

At present, a method for visualizing image information through an electrostatic latent image (electrostatic image), such as electrophotography, is utilized in various fields. Hitherto, in the electrophotography, there is generally adopted a method for performing visualization through plural steps including forming an electrostatic image on a photoreceptor or an electrostatic recording material using various methods; adhering a detectable particle called a "toner" to this electrostatic image, thereby developing the electrostatic latent image to form a toner image; and transferring this toner image onto the surface of a transfer-receiving material, followed by fixing it by heating or the like.

In the image formation by an electrophotography system, it is known that in addition to usual full-color toners such as a yellow toner, a magenta toner, a cyan toner and a black toner, a white toner is used.

SUMMARY

According to an aspect of the invention, there is provided an electrostatic image developing toner containing:

a binder resin and at least two different kinds of white pigments, wherein from about 10% by weight to about 30% by weight of the at least two kinds of white pigments is porous titanium oxide having a volume average particle diameter of from about 0.01 μm to about 1 μm, a particle size distribution (volume average particle size distribution index GSDv) of from about 1.1 to about 1.3 and a BET

DETAILED DESCRIPTION (1) Electrostatic Image Developing Toner:

The electrostatic image developing toner according to the exemplary embodiment (hereinafter also referred to simply as a "toner") is a white toner and comprises a binder resin and at least two different kinds of white pigments, wherein from 10% by weight to 30% by weight or from about 10% by weight to about 30% by weight of the at least two kinds of white pigments is porous titanium oxide having a volume average particle diameter of from 0.01 μm to 1 μm or from about 0.01 μm to about 1 μm, a particle size distribution (volume average particle size distribution index GSDv) of from 1.1 to 1.3 or from about 1.1 to about 1.3 and a BET specific surface area of from 250 $m^2/g$ to 500 $m^2/g$ or from about 250 $m^2/g$ to about 500 $m^2/g$. The present exemplary embodiment is hereunder described in more detail.

In the present exemplary embodiment, a description regarding "from A to B" (however, A<B) expressing a numerical value range is synonymous with "A or more and B or less" unless otherwise indicated and means a numerical value range including A and B, each of which is an end thereof. Also, similarly, a description regarding "from X to Y" (however, X>Y) expressing a numerical value range is synonymous with "X or less and Y or more" unless otherwise indicated and means a numerical value range including X and Y, each of which is an end thereof.

For example, inorganic materials such as titanium oxide, zinc oxide and zinc sulfide are generally used as the pigment to be used for the white toner. Of these, titanium oxide is excellent in hiding power.

As titanium oxide which is used as the white pigment, there are known two kinds of titanium oxide including titanium oxide having a rutile type crystal structure and titanium oxide having an anatase type crystal structure. In particular, it is known that the rutile type titanium oxide is suitable as a pigment inclusive of those for outdoor paints because it is low in photocatalytic action, hardly generates chalking and is excellent in light resistance as compared with the anatase type titanium oxide.

However, since the rutile type titanium oxide is high in absorption at around 400 nm, it is slightly tinged with yellow as a complementary color and has slightly yellowish hue as compared with the anatase type titanium oxide. For that reason, in the rutile type titanium oxide, it is difficult to obtain a sufficient whiteness.

In the toner according to the present exemplary embodiment, porous titanium oxide which is contained in a specified content in the at least two different kinds of white pigments and which has specified volume average particle diameter, particle size distribution and BET specific surface area scatters light of a blue region in a complementary color relation with yellow in high efficiency. According to this, the yellow tint that other white pigment, in particular, rutile type titanium oxide has is reduced, and the whiteness is enhanced. Also, by regulating the content of such porous titanium oxide in the white pigments to a specified content, the excellent light resistance is kept, and deterioration of an image, such as a crack, is prevented from occurring.

(Binder Resin)

The toner according to the present exemplary embodiment contains at least a binder resin.

Examples of the binder resin include homopolymers or copolymers of a styrene such as styrene and chlorostyrene; a monoolefin such as ethylene, propylene, butylene and isoprene; a vinyl ester such as vinyl acetate, vinyl propionate, vinyl benzoate and vinyl acetate; an acrylic ester or a methacrylic ester such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether such as vinyl methyl ether, vinyl ethyl ether and vinyl butyl ether; a vinyl ketone such as vinyl methyl ketone, vinyl hexyl ketone and vinyl isopropenyl ketone; or the like. Also, there are exemplified a polyester, a polyurethane, an epoxy resin, a silicone resin, a polyamide, a modified rosin, a paraffin and a wax. Of these, a polyester or an acrylic ester is preferable, and a polyester is especially preferable.

The polyester (also referred to as polyester resin herein) which is used in the present exemplary embodiment is, for example, synthesized through polycondensation of a polyol and a polycarboxylic acid. Incidentally, a commercially available material may be used.

Examples of the polycarboxylic acid include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; and aromatic dicarboxylic acids such as dibasic acids, for example, phthalic acid, isophthalic acid, terephthalic acid, naphthalene-2,6-dicarboxylic acid, malonic acid and mesaconic acid. In addition, their anhydrides or lower alkyl esters with a carbon number of from 1 to 3 are also exemplified.

Examples of trivalent or higher valent polycarboxylic acids include 1,2,4-benzenetricarboxylic acid, 1,2,5-benzenetricarboxylic acid, 1,2,4-naphthalenetricarboxylic acid, and anhydrides or lower alkyl esters thereof. These materials may be used singly or in combination of two or more kinds thereof.

Furthermore, in addition to the foregoing polycarboxylic acids, a dicarboxylic acid having an ethylenically unsaturated bond may be contained. Such a dicarboxylic acid is suitably used for the purpose of preventing hot offset at the time of fixing upon being crosslinked via the ethylenically unsaturated bond. Examples of such a dicarboxylic acid include maleic acid, fumaric acid, 3-hexenedioic acid and 3-octenedioic acid. However, such a dicarboxylic acid is not limited thereto. Also, their lower alkyl esters with a carbon number of from 1 to 3 or acid anhydrides or the like are exemplified. Of these, in view of costs, fumaric acid, maleic acid or the like is preferable.

As for the polyol, examples of a dihydric alcohol include alkylene (carbon number: 2 to 4) oxide adducts of bisphenol A (average addition molar number: 1.5 to 6), such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, 1,4-butanediol, 1,3-butanediol and 1,6-hexanediol.

Among the polyol, examples of a trihydric or higher polyhydric alcohol include sorbitol, pentaerythritol, glycerol and trimethylolpropane.

As for an amorphous polyester resin (also referred to as a "non-crystalline polyester resin"), among the foregoing raw material monomers, dihydric or higher polyhydric secondary alcohols and/or divalent or higher valent aromatic carboxylic acid compounds are preferable. Examples of the dihydric or higher polyhydric secondary alcohol include a propylene oxide adduct of bisphenol A, propylene glycol, 1,3-butanediol and glycerol. Of these, a propylene oxide adduct of bisphenol A is preferable.

As the divalent or higher valent aromatic carboxylic acid compound, terephthalic acid, isophthalic acid, phthalic acid or trimellitic acid is preferable, and terephthalic acid or trimellitic acid is more preferable.

Also, a resin having a softening temperature of from 90° C. to 150° C., a glass transition temperature of from 50° C. to 75° C. or from about 50° C. to about 75° C., a number average molecular weight of from 2,000 to 10,000, a weight average molecular weight of from 8,000 to 150,000 or from about 8,000 to about 150,000, an acid number of from 5 mg-KOH/g to 30 mg-KOH/g or from about 5 mg-KOH/g to about 30 mg-KOH/g and a hydroxyl number of from 5 mg-KOH/g to 40 mg-KOH/g is especially preferably used.

Also, for the purpose of imparting low-temperature fixability to the toner, it is preferable to use a crystalline polyester resin as a part of the binder resin.

The amount of the crystalline polyester resin is preferably from 5% by weight to 60% by weight, more preferably from 10% by weight to 50% by weight, and still more preferably from 15% by weight to 45% by weight, relative to the total weight of the binder resin.

The crystalline polyester resin is preferably constituted of an aliphatic dicarboxylic acid and an aliphatic diol, and more preferably constituted of a straight chain type dicarboxylic acid and a straight chain type aliphatic diol, in which each of the main chain segments has a carbon number of from 4 to 20. In the case of a straight chain type, because of excellent crystallinity and appropriate crystal melting temperature of the polyester resin, excellent toner blocking resistance, image storage stability and low-temperature fixability are revealed. Also, when the carbon number is 4 or more, the polyester resin is appropriate in an ester bond concentration in the toner, and hence, it is adequate in electrical resistance and excellent in chargeability of the toner. Also, when the carbon number is 20 or less, practically useful materials are easily available. The carbon number is more preferably 14 or less.

Examples of the aliphatic dicarboxylic acid which is suitably used for the synthesis of the crystalline polyester include oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, and lower alkyl esters or acid anhydrides thereof. However, it should not be construed that the invention is limited thereto. Of these, taking into consideration easiness of availability, sebacic acid or 1,10-decanedicaboxylic acid is preferable.

Specific examples of the aliphatic diol include ethylene glycol, 1,3-propanediol, 1,4-butanediol, 1,5-pentanediol, 1,6-hexanediol, 1,7-heptanediol, 1, 8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. However, it should not be construed that the invention is limited thereto. Of these, taking into consideration easiness of availability, 1,8-octanediol, 1,9-nonanediol or 1,10-decanediol is preferable.

Examples of the trihydric or higher polyhydric alcohol include glycerin, trimethylolethane, trimethylolpropane and pentaerythritol. These materials may be used singly or in combination of two or more kinds thereof.

A content of the aliphatic dicarboxylic acid in the polycarboxylic acid is preferably 80% by mol or more or about 80% by mol or more, and more preferably 90% by mol or more or about 90% by mol or more. When the content of the aliphatic dicarboxylic acid is 80% by mol or more or about 80% by mol or more, because of excellent crystallinity and adequate melting temperature of the polyester resin, excellent toner blocking resistance, image storage properties and low-temperature fixability are revealed.

A content of the aliphatic diol in the polyol is preferably 80% by mol or more or about 80% by mol or more, and more preferably 90% by mol or more or about 90% by mol or more. When the content of the aliphatic diol is 80% by mol or more or about 80% by mol or more, because of excellent crystallinity and adequate melting temperature of the polyester resin, excellent toner blocking resistance, image storage properties and low-temperature fixability are revealed.

Incidentally, if desired, for the purpose of adjusting the acid number or hydroxyl number or other purposes, a monovalent acid such as acetic acid and benzoic acid, or a monohydric alcohol such as cyclohexanol and benzyl alcohol, is also useful.

A manufacturing method of the polyester is not particularly limited, and examples thereof include a polyester polymerization method of allowing the foregoing polycarboxylic acid or the like and the foregoing polyol or the like to react with each other. Specific examples thereof include a direct polycondensation method and an ester interchange method. The polymerization method is varied depending upon the kinds of the monomers.

The polyester is, for example, manufactured by blending the foregoing polyol and polycarboxylic acid and optionally, a catalyst in a reactor equipped with a thermometer, a stirrer and a flow-down type condenser; heating the mixture at from 150° C. to 250° C. in the presence of an inert gas (for example, a nitrogen gas, etc.), thereby continuously removing a low-molecular weight compound produced as a by-product out the reaction system; and stopping the reaction at a point of time when the reaction product reaches a prescribed molecular weight, followed by cooling to obtain a desired reaction product.

In the case that the polyester is composed of a polycarboxylic acid and a polyol and the like, it is preferable that 80% by mol or more or about 80% by mol or more of a polycarboxylic acid-derived component constituting the polyester resin, relative to 100% by mol of the polycarboxylic acid-derived component, is an aliphatic dicarboxylic acid.

Moreover, in the case that the polyester is composed of a polycarboxylic acid and a polyol and the like, it is preferable that 80% by mol or more or about 80% by mol or more of a polyol-derived component constituting the polyester resin, relative to 100% by mol of the polyol-derived component, is an aliphatic polyol.

Though a content of the binder resin in the toner according to the present exemplary embodiment is not particularly limited, it is preferably from 5% by weight to 95% by weight, more preferably from 20% by weight to 90% by weight, and still more preferably from 40% by weight to 85% by weight relative to the total weight of the toner. When the content of the binder resin falls within the foregoing ranges, excellent fixability, storage properties, powder characteristics and charge characteristics are revealed.

(White Pigment)

The toner according to the present exemplary embodiment contains at least two different kinds of white pigments, and from 10% by weight to 30% by weight or from about 10% by weight to about 30% by weight of the at least two kinds of white pigments is porous titanium oxide having a volume average particle diameter of from 0.01 μm to 1 μm or from about 0.01 μm to about 1 μm, a particle size distribution of from 1.1 to 1.3 or from about 1.1 to about 1.3 and a BET specific surface area of from 250 $m^2/g$ to 500 $m^2/g$ or from about 250 $m^2/g$ to about 500 $m^2/g$.

The porous titanium oxide and other white pigment than the porous titanium oxide, both of which are used in the toner according to the present exemplary embodiment, are hereunder described.

(Porous Titanium Oxide)

The porous titanium oxide which is used in the present exemplary embodiment is preferably a substantially spherical secondary particle obtained by aggregation among primary particles of titanium oxide. The terms "substantially spherical" as referred to herein mean that a ratio of a minor axis to a major axis (minor axis/major axis) is 0.75 or more. When the ratio of a minor axis to a major axis is 0.75 or more, light of a blue region is scattered without being diffused. The foregoing secondary particle is preferably one obtained by aggregation among primary particles in a coarse state and is a porous material having a large number of pores (spaces).

A BET specific surface area of the porous titanium oxide is from 250 $m^2/g$ to 500 $m^2/g$ or from about 250 $m^2/g$ to about 500 $m^2/g$.

When the BET specific surface area of the porous titanium oxide is less than 250 $m^2/g$ or less than about 250 $m^2/g$, the scattering intensity of light in a blue region in a complementary color relation with yellow becomes weak, so that a blue color development effect for reducing the yellow tint of other white pigment is not obtainable.

Also, when the BET specific surface area of the porous titanium oxide exceeds 500 $m^2/g$ or about 500 $m^2/g$, the primary particles coarsely aggregate, so that a favorable particle size distribution is not obtainable. Thus, a hiding power is not obtainable.

The BET specific surface area of the porous titanium oxide is preferably from 300 $m^2/g$ to 500 $m^2/g$ or from about 300 $m^2/g$ to about 500 $m^2/g$, and more preferably 350 $m^2/g$ to 400 $m^2/g$ or about 350 $m^2/g$ to about 400 $m^2/g$. What the BET specific surface area of the porous titanium oxide falls within the foregoing numerical value ranges is preferable because a favorable whiteness can be realized while acquiring a hiding power.

The BET specific surface area is measured by separating titanium oxide from the toner. As the separation method, titanium oxide is very heavy in a specific gravity as compared with resins or aqueous media and easily subjected to solid-liquid separation, and therefore, a separation method utilizing such a matter is adopted.

For example, the toner is added to a solvent with a high resin solubility, represented by tetrahydrofuran, toluene or the like (for example, 1 g of the toner is added to 100 g of the solvent), and the mixture is allowed to stand. After a lapse of one hour, a supernatant is discarded, and a precipitate is dried. At that time, the supernatant is composed of the solvent and the resin-dissolved material, whereas the precipitate is composed of titanium oxide.

The BET specific surface area is measured by a nitrogen substitution method. For example, the BET specific surface area is measured by a three-point method using an SA3100 specific surface area analyzer (manufactured by Beckman Coulter Inc.). Specifically, 5 of titanium oxide as a measurement sample is charged into a cell and subjected to a deaeration treatment at 60° C. for 120 minutes, followed by measuring the BET specific surface area using a mixed gas (30/70) of nitrogen and helium.

A volume average particle diameter of the foregoing porous titanium oxide is from 0.01 μm to 1 μm or from about 0.01 μm to about 1 μm.

When the volume average particle diameter of the porous titanium oxide is less than 0.01 μm or less than about 0.01 μm, light is permeated therethrough, whereby the hiding power is lowered.

Also, when the volume average particle diameter of the porous titanium oxide exceeds 1 μm or about 1 μm, it is difficult to contain the porous titanium oxide in the toner.

The volume average particle diameter of the porous titanium oxide is preferably from 0.015 μm to 0.35 μm or from about 0.015 μm to about 0.35 μm, and more preferably from 0.02 μm to 0.30 μm or from about 0.02 μm to about 0.30 μm. What the volume average particle diameter of the porous titanium oxide falls within the foregoing numerical value ranges is preferable because the pigment is contained in a high density in the toner, so that a sufficient hiding power is obtainable.

Incidentally, a volume average particle diameter of titanium oxide serving as a primary particle is preferably from 0.001 μm to 0.05 μm or from about 0.001 μm to about 0.05 μm.

Incidentally, the volume average particle diameter of the porous titanium oxide is measured by separating the porous titanium oxide from the toner as described above.

A particle size distribution of the foregoing porous titanium oxide is from 1.1 to 1.3 or from about 1.1 to about 1.3. The particle size distribution of the porous titanium oxide as referred to in the present exemplary embodiment means a volume average particle size distribution index GSDv of the porous titanium oxide.

When the particle size distribution of the porous titanium oxide is less than 1.1 or less than about 1.1, the light scattering intensity becomes weak, so that a sufficient color development effect is not obtainable.

Also, when the particle size distribution of the porous titanium oxide exceeds 1.3 or about 1.3, problems in the image formation including a trouble after the development are caused.

The particle size distribution of the foregoing porous titanium oxide is from 1.1 to 1.3 or from about 1.1 to about 1.3, and preferably from 1.15 to 1.25 or from about 1.15 to about 1.25. What the particle size distribution of the porous titanium oxide falls within the foregoing numerical value ranges is preferable because a sufficient color development effect is brought without causing mottle.

The particle size distribution is measured by a measuring device such as Multisizer II (manufactured by Beckman Coulter Inc.).

Here, a volume average particle diameter at 16% accumulation is defined as $D_{16v}$; a volume average particle diameter at 50% accumulation is defined as $D_{50v}$; and a volume average particle diameter at 84% accumulation is defined as $D_{84v}$. Then, the volume average particle size distribution index GSDv is calculated according to the following expression.

$$GSDv=((D_{84v}/D_{50v})\times(D_{50v}/D_{16v}))^{1/2}$$

An average circularity of the foregoing porous titanium oxide is preferably more than 0.970 or more than about 0.970, and more preferably more than 0.970 and less than 0.990 or more than about 0.970 and less than about 0.990. What the average circularity of the porous titanium oxide falls within the foregoing numerical value ranges is preferable because a favorable whiteness can be realized while acquiring the hiding power.

The average circularity of the porous titanium oxide can be measured by a flow type particle image analyzer FPIA3000 (manufactured by Sysmex Corporation). As a specific measurement method, a porous titanium oxide dispersion liquid is diluted in a concentration of 0.1% and charged into a cell, followed by the measurement.

As for the foregoing porous titanium oxide, it is preferable that from 10% by weight to 50% by weight thereof or from about 10% by weight to about 50% by weight thereof is of an anatase type crystal structure, and it is more preferable that from 20% by weight to 40% by weight thereof or from about 20% by weight to about 40% by weight thereof is of an anatase type crystal structure. What the porous titanium oxide falls within the foregoing numerical value ranges is preferable because not only the generation of chalking is suppressed, but the above-specified BET specific surface area, volume average particle diameter and particle size distribution are easily obtainable.

A content of the anatase type crystal in the porous titanium oxide (anatase ratio) is measured by means of X-ray diffraction. In view of the fact that a lattice constant, namely an interference angle of the X-ray diffraction varies depending upon the crystal system, according to this method, it is possible to determine the content of an anatase-rutile mixed system.

A content of the porous titanium oxide is from 10% by weight to 30% by weight or from about 10% by weight to about 30% by weight of the whole of the at least two different kinds of white pigments contained in the toner according to the present exemplary embodiment.

When the content of the porous titanium oxide is less than 10% by weight or less than about 10% by weight, a sufficient hiding power is not obtainable.

Also, when the content of the porous titanium oxide exceeds 30% by weight or about 30% by weight, the specific gravity of the toner becomes heavy, so that developability becomes worse.

The content of the porous titanium oxide is from 10% by weight to 30% by weight or from about 10% by weight to about 30% by weight, and preferably from 15% by weight to 25% by weight or from about 15% by weight to about 25% by weight. What the content of the porous titanium oxide falls within the foregoing numerical value ranges is preferable because sufficient hiding power and whiteness are achieved, and other various characteristics including developability are not influenced.

When the porous titanium oxide has a volume average particle diameter of from 0.01 μm to 1 μm or from about 0.01 μm to about 1 μm, a particle size distribution of from 1.1 to 1.3 or from about 1.1 to about 1.3 and a BET specific surface area of from 250 $m^2/g$ to 500 $m^2/g$ or from about 250 $m^2/g$ to about 500 $m^2/g$, blue light, specifically light of from 400 nm to 500 nm is reflected at a high spectral reflectance.

What the titanium oxide according to the present exemplary embodiment reflects blue light at a high spectral reflectance is, for example, measured by means of photometry of a wavelength of a titanium oxide aqueous solution using a spectrophotometer Ultra Scan (manufactured by Prime Tech Ltd.).

The porous titanium oxide is, for example, prepared by heating an aqueous solution of a titanium salt (titanium salt aqueous solution) in the presence of an aliphatic alcohol and/or a compound having a carboxyl group or a carbonyl group (hereinafter also referred to as an "aliphatic alcohol or the like") to hydrolyze the titanium compound, followed by a heat treatment with an acid.

Specifically, when the aliphatic alcohol or the like is added to the aqueous solution of titanium salt and heated, a white precipitate is formed. After heat treating it with an acid, it is preferable that the pH is further adjusted by an alkaline treatment, followed by water washing and drying (furthermore, baking is also possible). Incidentally, in the case of omitting the foregoing alkaline treatment, a percent yield or a material quality is lowered.

As a starting raw material for preparing the titanium salt aqueous solution, an aqueous solution of an inorganic titanium salt such as titanium sulfate, titanyl sulfate and titanium tetrachloride is used. Also, an aqueous solution of an organic titanium salt such as titanium tetraisopropoxide is used as the starting raw material.

A concentration of the titanium salt aqueous solution is preferably from 0.1 mol/L to 5 mol/L.

The volume average particle diameter and BET specific surface area of the porous titanium oxide are adjusted by the addition amount of the aliphatic alcohol or the like which is added at the time of hydrolyzing the titanium compound contained in the aqueous solution of a titanium salt. This is because the aliphatic alcohol or the like influences the particle diameter or aggregated state of the primary particle, and as a result, the volume average particle diameter and specific surface area of the porous titanium oxide that is a secondary particle change.

A concentration of the aliphatic alcohol or the like may be properly determined depending upon the raw material to be used or the kind of the aliphatic alcohol or the like. When the addition amount of the aliphatic alcohol or the like is too small, the ratio of anatase as a crystal type of the porous titanium oxide becomes small, and the BET specific surface area also becomes small.

Also, when the addition amount of the aliphatic alcohol or the like is too large, the shape collapses, or the BET specific surface area becomes small.

For example, when titanyl sulfate is used as the titanium salt, titanium oxide of an anatase type is obtained. However, from the standpoints of the shape and BET specific surface area, the concentration of the aliphatic alcohol is preferably from 0.1 mol/L to 5 mol/L, and more preferably from 0.5 mol/L to 3 mol/L in the titanium salt aqueous solution.

Also, when a titanium tetrachloride aqueous solution is used as the titanium salt aqueous solution, a concentration of the aliphatic alcohol (for example, glycerin) is preferably from 1.5 mol/L to 5 mol/L, and more preferably from 1.5 mol/L to 3 mol/L in the titanium salt aqueous solution.

Incidentally, in the case of using a compound having a carboxyl group or a compound having a carbonyl group as described later in combination therewith, the concentration of the aliphatic alcohol is not limited to the foregoing ranges.

As a monohydric aliphatic alcohol which is used at the time of hydrolysis by heating, one with a carbon number of from 1 to 22 is preferable, and examples thereof include methanol, ethanol, isopropyl alcohol, butyl alcohol, octanol and stearyl alcohol.

In order to make the shape of titanium oxide substantially spherical, it is preferable to use a polyhydric alcohol.

Though the polyhydric alcohol is not particularly limited, ethylene glycol, propylene glycol, 1,4-butylene glycol, 2,3-butylene glycol, 1,3-butylene glycol, dimethylpropanediol, diethylpropanediol, glycerin, trimethylolpropane, triethylolpropane, erythritol, xylitol, mannitol, sorbitol, maltitol or the like is suitably useful. Of these, glycerin is especially preferable.

Even when the monohydric aliphatic alcohol is used, a porous secondary particle is formed. However, as compared with the case of using a polyhydric alcohol, substantially spherical titanium oxide is hardly formed. In the case of using a monohydric alcohol, this point of issue is improved by using a compound having a carboxyl group or a compound having a carbonyl group in combination therewith.

The condition of the hydrolysis by heating is properly determined by the kind or concentration or the like of the raw material to be used or the additive such as the aliphatic alcohol or the like. A heating temperature is preferably from 50° C. to 100° C. A heating time is preferable from 1 hour to 12 hours.

In the present exemplary embodiment, after the hydrolysis by heating, it is preferable to perform a heat treatment with an acid. Specifically, after the hydrolysis by heating, an acid is added to a slurry obtained by again suspending a filtration residue in water, followed by heating. Examples of such an acid include sulfuric acid, nitric acid and hydrochloric acid. Of these, hydrochloric acid is preferable.

By such a heat treatment by the addition of an acid (acid heat treatment), porous titanium oxide having a BET specific surface area of 250 $m^2/g$ or more or about 250 $m^2/g$ or more is prepared. In the case of not performing the acid heat treatment or not adding the aliphatic alcohol or the like at the time of hydrolysis, a powder having a large BET specific surface area is not formed. Also, by the acid heat treatment, the particle diameter of the powder becomes small and uniform as compared with that before the acid heat treatment.

An addition amount of the acid in the acid heat treatment is preferably from 1 molar equivalent to 8 molar equivalents to titanium in the slurry. Though the heating condition may be properly determined depending upon the raw material to be used, the additive, the concentration or the like, it is the same range as that of the condition of the hydrolysis by heating.

In the present exemplary embodiment, after the acid heat treatment, it is desirable to perform neutralization by adding an alkali to the reaction solution (or the slurry obtained by filtering and water washing the reaction solution and then again suspending it in water), thereby adjusting a pH preferably at from 6 to 8, and more preferably at from 6.5 to 7.5. Though the alkali to be used is not particularly limited, Na salts, K salts and Ca salts such as sodium hydroxide, sodium carbonate, potassium hydroxide and calcium hydroxide are preferable.

In the present exemplary embodiment, when a compound having a carboxyl group or a compound having a carbonyl group is allowed to coexist together with the aliphatic alcohol, the ratio of containing titanium oxide of an anatase type tends to become high.

In the case of using a titanium tetrachloride aqueous solution as the titanium salt aqueous solution, in order to regulate the anatase ratio to 50% by weight or less or about 50% by weight or less, it is preferable to use acetic acid in an amount of 2 mol or less per 1 mol of the aliphatic alcohol. Also, when the compound having a carboxyl group or the compound having a carbonyl group is used in combination with the aliphatic alcohol, the particle diameter of the porous titanium oxide tends to become small as compared with the case of not using the compound having a carboxyl group or the compound having a carbonyl group in combination with the aliphatic alcohol. Also, the use amount of additives can be reduced.

Though the compound having a carboxyl group or the compound having a carbonyl group is not particularly limited, aliphatic compounds with a carbon number of from 1 to 22 are preferable, and examples thereof include aliphatic carboxylic acids and derivatives thereof.

Examples of the aliphatic carboxylic acid include monobasic acids such as formic acid, acetic acid, propionic acid, caprylic acid and stearic acid; and dibasic acids such as oxalic acid, malonic acid, succinic acid, adipic acid and maleic acid; and in addition to these, higher polybasic acids. As the derivatives, though salts such as alkali metal salts, alkaline earth metal salts and quaternary ammonium salts; esters such as methyl esters and ethyl esters; and so on are representative, amino acids, amides or the like are also used within the range where no particular hindrance is present. Also, there are exemplified aromatic carboxylic acids such as salicylic acid and benzoic acid.

Of these, a carboxylic acid or a carboxylic acid salt is preferable; acetic acid, oxalic acid, salicylic acid, propionic acid, succinic acid, malonic acid or benzoic acid is more preferable; and acetic acid or propionic acid is especially preferable.

Though a concentration of the compound having a carboxyl group or the compound having a carbonyl group may be properly determined depending upon the kind of the compound or other conditions, it is preferably from 0.1 mol/L to 5 mol/L, and more preferably from 0.5 mol/L to 5 mol/L in the titanium salt aqueous solution.

Also, even when only the compound having a carboxyl group or the compound having a carbonyl group is used as the additive in place of the aliphatic alcohol, the porous titanium oxide is prepared. In that case, the compound having a carboxyl group or the compound having a carbonyl group is preferably acetic acid. In the case of using the compound having a carboxyl group or the compound having a carbonyl group in place of the aliphatic alcohol, there may be the case where the particle size or shape is deteriorated as compared with the case of using the aliphatic alcohol.

As a manufacturing method of porous titanium oxide, a method in which glycerin is added in an amount of from 1.5 mol to 5 mol per 1 mol of titanium tetrachloride to the titanium tetrachloride aqueous solution, and the mixture is heat hydrolyzed by heating, followed by subjecting to a heat treatment with an acid is especially preferable.

Also, a method in which glycerin is added in an amount of from 0.1 mol to 5 mol per 1 mol of titanium tetrachloride to the titanium tetrachloride aqueous solution, acetic acid is further added in an amount of 2-fold molar equivalents or more to glycerin, and the mixture is heat hydrolyzed, followed by subjecting to a heat treatment with an acid is one of especially preferred methods.

Furthermore, when a metal particle is supported on the porous titanium oxide powder, it is possible to conspicuously enhance a photocatalytic ability in a small supporting amount.

As the metal, there are exemplified those capable of capturing an electron when light is irradiated on titanium oxide to produce an electron and a hole. For example, Au, Pt, Ag, Cu or Pd is suitably used.

As the method for supporting a metal, though known methods can be adopted, a photoreduction method is simple and easy. Specifically, a method in which the porous titanium oxide is dispersed in water, a metal salt aqueous solution is added thereto, and ultraviolet rays are irradiated may be adopted. Thereafter, filtration, water washing and drying are performed, thereby obtaining a metal-supported powder.

Examples of the metal salt include nitrates, acetate, carbonates, sulfates and chlorides. Water is suitable as a solvent. However, ethanol, propanol or the like may also be used. Incidentally, if desired, the solvent can be subjected to pH adjustment with an acid or an alkali. So far as the effect according to the present exemplary embodiment is exhibited, the metal supporting amount is not particularly limited. In general, the metal amount is preferably from 0.01% by weight to 2% by weight, and preferably from 0.1% by weight to 1% by weight relative to the powder on which a metal is to be supported.

As a light source for irradiating ultraviolet rays, in addition to an ultraviolet lamp, light sources capable of irradiating light including ultraviolet rays, such as a BLB lamp, a xenon lamp, a mercury vapor lamp and a fluorescent lamp, can be used. At the time of irradiating ultraviolet rays, an irradiation position or time or the like is set up such that ultraviolet rays can be sufficiently irradiated on the reaction solution.

(White Pigment Other than Porous Titanium Oxide)

The toner according to the present exemplary embodiment contains a white pigment other than the foregoing porous titanium oxide. Though the white pigment other than the porous titanium oxide is not particularly limited, examples thereof include rutile type titanium oxide, anatase type titanium oxide and brookite type titanium oxide. Of these, rutile type titanium oxide is preferable from the standpoint that it is low in photocatalytic action, hardly generates chalking and is excellent in light resistance.

In the case of using rutile type titanium oxide and porous titanium oxide in combination, a weight ratio of rutile type titanium oxide to porous titanium oxide is preferably from 90/10 to 70/30, and more preferably from 85/15 to 75/25. What the weight ratio of rutile type titanium oxide to porous titanium oxide falls within the foregoing numerical value ranges is preferable because a blue color development effect for reducing a yellow tint of rutile type titanium oxide by the porous titanium oxide can be obtained while suppressing the generation of chalking.

A total content of the at least two kinds of white pigments contained in the toner according to the present exemplary embodiment is preferably from 5% by weight to 50% by weight or from about 5% by weight to about 50% by weight, and more preferably from 20% by weight to 40% by weight or from about 20% by weight to about 40% by weight, relative to the whole weight of the toner. When the total content of the at least two kinds of white pigments is 50% by weight or less or about 50% by weight or less, the hardness of the toner is suppressed to a low level, and cracking of an image is prevented from occurring. When the total content of the at least two kinds of white pigments is 5% by weight or more or about 5% by weight or more, a sufficient hiding power is obtainable.

(Release Agent)

It is preferable that the toner according to the present exemplary embodiment contains a release agent.

The release agent which is used in the present exemplary embodiment is not particularly limited, and known materials are useful. Examples thereof include a paraffin wax and derivatives thereof, a montan wax and derivatives thereof, a microcrystalline wax and derivatives thereof, a Fischer-Tropsch wax and derivatives thereof, and a polyolefin wax and derivatives thereof. The "derivatives" as referred to herein include an oxide, a polymer with a vinyl monomer, and a graft modified product. Besides, alcohols, fatty acids, vegetable waxes, animal waxes, mineral waxes, ester waxes, acid amides and so on are also useful.

It is preferable that the release agent is melted at any temperature of from 70° C. to 140° C. or from about 70° C. to about 140° C. and has a melt viscosity of from 1 centipoise to 200 centipoises or from about 1 centipoise to about 200 centipoises.

It is preferable that the wax which is used as the release agent is melted at any temperature of from 70° C. to 140° C. or from about 70° C. to about 140° C. and has a melt viscosity of from 1 centipoise to 200 centipoises or from about 1 centipoise to about 200 centipoises. It is more preferable that the wax has a melt viscosity of from I centipoise to 100 centipoises or from about 1 centipoise to about 100 centipoises. When the temperature at which the wax is melted is 70° C. or higher or about 70° C. or higher, the temperature at which the wax varies is sufficiently high, and excellent blocking resistance and developability when the temperature within an image forming apparatus increases are revealed. When the temperature at which the wax is melted is 140° C. or less or about 140° C. or less, the temperature at which the wax varies is sufficiently low, it is not necessary to perform fixing at high temperatures, and excellent energy saving is revealed. Also, when the melt viscosity of the wax is 200 centipoises or less or about 200 centipoises or less, elution of the wax from the toner is adequate, and excellent fixing releasability is revealed.

A content of the release agent is preferably from 3% by weight to 60% by weight, more preferably from 5% by weight to 40% by weight, and still more preferably from 7% by weight to 20% by weight relative to the whole weight of the toner. When the content of the release agent falls within the foregoing ranges, not only more excellent toner offset-preventing properties onto a heating member are revealed, but more excellent feed roll contamination-preventing properties are revealed.

(Internal Additive)

In the present exemplary embodiment, an internal additive may be added in the inside of the toner. In general, the internal additive is used for the purpose of controlling viscoelasticity of the fixed image.

Specific examples of the internal additive include inorganic particles such as silica and organic particles such as polymethyl methacrylate. Also, for the purpose of enhancing dispersibility, the internal additive may be subjected to a surface treatment. Also, the internal additive may be used singly or in combination of two or more kinds thereof.

(External Additive)

In the present exemplary embodiment, an external additive such as fluidizing agent and a charge controlling agent may be subjected to an addition treatment to the toner.

As the external agent, known materials such as inorganic particles, for example, a silica particle, the surface of which is treated with a silane coupling agent, etc., a titanium oxide particle, an alumina particle, a cerium oxide particle, etc.; polymer particles, for example, polycarbonate, polymethyl methacrylate, a silicone resin, etc.; amine metal salts; and salicylic acid metal complexes are useful. The external additive which is used in the present exemplary embodiment may be used singly or in combination of two or more kinds thereof.

(Shape of Toner)

A volume average particle diameter of the toner according to the present exemplary embodiment is preferably from 2 μm to 9 μm, and more preferably from 3 μm to 7 μm. When the volume average particle diameter of the toner falls within the foregoing ranges, excellent chargeability and developability are revealed.

Also, it is preferable that the toner according to the present exemplary embodiment has a volume average particle size distribution index GSDv of 1.30 or less or about 1.30 or less. When the volume average particle size distribution index GSDv of the toner is 1.30 or less or about 1.30 or less, excellent graininess and charge retention properties are revealed.

Incidentally, in the present exemplary embodiment, values of the particle diameter of the toner and the foregoing volume average particle size distribution index GSDv are measured and calculated in the following manner. First of all, an cumulative distribution of the volume of each of the toner particles is drawn from the small diameter side with respect to the particle diameter range (channel) divided on the basis of the particle size distribution of the toner measured using a measuring device such as Multisizer II (manufactured by Beckman Coulter Inc.), and the particle diameter at 16% accumulation is defined as a volume average particle diameter $D_{16v}$, and the particle diameter at 50% accumulation is defined as a volume average particle diameter $D_{50v}$. Similarly, the particle diameter at 84% accumulation is defined as a volume average particle diameter $D_{84v}$. On that occasion, as for the volume average particle size distribution index (GSDv), the volume average particle size distribution index (GSDv) is calculated using a relational expression defined as $D_{84v}/D_{16v}$.

Also, a shape factor SF1 (=((absolute maximum length of toner diameter)$^2$/(projected area of toner))×(π/4)×100) of the toner according to the present exemplary embodiment is preferably in the range of from 110 to 160 or from about 110 to about 160, and more preferably in the range of from 125 to 140 or from about 125 to about 140. The value of the shape factor SF1 expresses roundness of the toner, and in the case of a true sphere, the shape factor SF1 is 100. As the shape of the toner becomes amorphous, the shape factor SF1 increases.

When the shape factor SF1 is 110 or more or about 110 or more, the generation of a residual toner in a transfer step at the image formation is suppressed, and excellent cleaning properties at cleaning using a blade or the like are revealed.

Meanwhile, when the shape factor SF1 is 160 or less or about 160 or less, in the case of using the toner as a developer, breakage of the toner to be caused due to a collision with a carrier within a developing device is prevented from occurring, resulting in suppressing the generation of a fine powder. According to this, contamination of the photoreceptor surface or the like with the release agent component exposed on the toner surface is prevented from occurring, whereby not only excellent charge characteristics are revealed, but, for example, the generation of a fog to be caused due to a fine powder is suppressed.

The values which become necessary at the calculation using the shape factor SF1, namely the absolute maximum length of the toner diameter and the projected area of the toner are determined by photographing a toner particle image enlarged with a magnification of 500 using an optical microscope (Microphoto-FXA, manufactured by Nikon Corporation), introducing the obtained image information into, for example, an image analyzer (Luzex III, manufactured by Nireco Corporation) via an interface and performing image analysis. An average value of the shape factor SF1 is calculated on the basis of data obtained by measuring 1,000 toner particles sampled at random.

(Manufacturing Method of Electrostatic Image Developing Toner)

A manufacturing method of the toner according to the present exemplary embodiment is not particularly limited, and examples thereof include a dry method such as a kneading pulverization method and a wet method such as a melt suspension method, an emulsion aggregation method and a dissolution suspension method. Above all, it is preferable that the toner is manufactured by an emulsion aggregation method.

The emulsion aggregation method as referred to herein is a method in which dispersion liquids (emulsion liquids) each containing a component contained in a toner matrix particle (for example, a binder resin, a release agent, a white pigment, etc.) are prepared, these dispersion liquids are mixed to aggregate the components contained in the toner matrix particle, thereby forming an aggregated particle, and thereafter, the aggregated particle is heated at a temperature of a melt fusion temperature or glass transition temperature of the binder resin or higher, thereby heat fusing the aggregated particle.

According to the emulsion aggregation method, a toner matrix particle with a small particle diameter is easily prepared, and a toner matrix particle with a narrow particle size distribution is easily obtained as compared with the kneading pulverization method that is a dry method, or the melt suspension method or dissolution suspension method that is other wet method or the like. Also, shape control is easy as compared with the melt suspension method or dissolution suspension method or the like, and a uniform amorphous toner matrix particle is prepared. Furthermore, structure control of the toner matrix particle, such as coating formation, is easy, and in the case of containing a release agent or a crystalline polyester resin, the surface exposure of such a material is suppressed, so that deterioration of chargeability or storage properties is prevented from occurring.

Next, a manufacturing step of the emulsion aggregation method is described in detail.

The emulsion aggregation method includes at least a dispersing step of granulating raw materials constituting a toner matrix particle to prepare a dispersion liquid having the respective raw materials dispersed therein; an aggregating step of forming an aggregate of raw material particles; and a fusing step of fusing the aggregate. An example of the manufacturing step of a toner matrix particle by the emulsion aggregation method is hereunder described for every step.

[Dispersing Step]

Examples of a preparation method of each of the resin particle dispersion liquid and the release agent particle dispersion liquid include a phase inversion emulsification method and a melt emulsification method. The dispersion step is hereunder described by referring to a binder resin as an example.

In the phase inversion emulsification method, a binder resin to be dispersed is dissolved in a hydrophobic organic solvent in which the binder resin is soluble, and a base is added to the organic continuous phase (oil phase: O), thereby achieving neutralization. Thereafter, when an aqueous medium (water phase: W) is thrown to convert a water-in-oil (W/O) system into an oil-in-water (O/W) system, thereby subjecting the binder resin existent in the organic continuous phase to phase inversion into a discontinuous phase. According to this, the binder resin is dispersed and stabilized in a granular state in the aqueous medium, whereby the resin particle dispersion liquid (emulsion liquid) is prepared.

In the melt emulsification method, a shear force is given from a dispersing machine to a solution having an aqueous medium and a binder resin mixed therein, whereby the emulsion liquid is prepared. On that occasion, the resin particle is formed by reducing the viscosity of the binder resin by heating. Also, in order to stabilize the dispersed resin particle, a dispersant may be used. Furthermore, when the binder resin is oily and relatively low in solubility in water, the resin particle dispersion liquid (emulsion liquid) may be prepared by dissolving the binder resin in a solvent in which the binder resin is soluble, dispersing it together with a dispersant and a polymer electrolyte in water and then transpiring the solvent by heating or under reduced pressure.

Examples of the dispersing machine which is used for the preparation of an emulsion liquid by the metal emulsification method include a homogenizer, a homomixer, a pressure kneader, an extruder and a medium dispersing machine.

Examples of the aqueous medium include water such as distilled water and ion-exchanged water; and an alcohol. The aqueous medium is preferably one made of only water.

Also, examples of the dispersant which is used for the dispersing step include water-soluble polymers such as polyvinyl alcohol, methyl cellulose, ethyl cellulose, hydroxyethyl cellulose, carboxymethyl cellulose, sodium polyacrylate and sodium polymethacrylate; and surfactants such as anionic surfactants (for example, sodium dodecylbenzenesulfonate, sodium octadecylsulfate, sodium oleate, sodium laurate, potassium stearate, etc.), cationic surfactants (for example, laurylamine acetate, stearylamine acetate, lauryltrimethylammonium chloride, etc.), amphoteric ionic surfactants (for example, lauryldimethylamine oxide, etc.) and nonionic surfactants (for example, polyoxyethylene alkyl ethers, polyoxyethylene alkylphenyl ethers, polyoxyethylene alkylamines, etc.). Of these, an anionic surfactant is suitably used from the viewpoints of easiness of washing and environmental appropriateness.

A content of the resin particle contained in the resin particle dispersion liquid (emulsion liquid) in the dispersing step is preferably from 10% by weight to 50% by weight, and more preferably from 20% by weight to 40% by weight. When the content of the resin particle is 10% by weight or more, the particle size distribution is not excessively spread. Also, when the content of the resin particle is 50% by weight or less, scattering-free stirring can be achieved, and a toner matrix particle with a narrow particle size distribution and complete characteristics is obtainable.

A volume average particle diameter of the resin particle is preferably in the range of from 0.08 μm to 0.8 μm, more preferably from 0.09 μm to 0.6 μm, and still more preferably from 0.10 μm to 0.5 μm. When the volume average particle diameter of the resin particle is 0.08 μm, the resin particle is easily aggregated. Also, when the volume average particle diameter of the resin particle is not more than 0.8 μm, the particle diameter distribution of the toner matrix particle is hardly spread, and precipitation of the emulsified particle is suppressed. Thus, the storage properties of the resin particle dispersion liquid are enhanced.

Before performing an aggregating step as described below, it would be better to prepare a dispersion liquid in which each of the components of the toner matrix particle other than the binder resin, such as the release agent and the white pigment, is dispersed.

Also, not only a method of preparing a dispersion liquid corresponding to each component but, for example, a method in which at the time of preparing a dispersion liquid of a certain component, other components are added to a solvent to simultaneously emulsify two or more components such that the plural components are contained in the dispersion liquid, may be adopted.

[Aggregating Step]

In the aggregating step, the resin particle dispersion liquid obtained in the foregoing dispersing step, the release agent dispersion liquid, the white pigment dispersion liquid and the like are mixed to form a mixed solution, which is then aggregated by heating at a temperature of not higher than the glass transition temperature of the binder resin, thereby forming an aggregated particle. The formation of an aggregated particle is performed under stirring by allowing the mixed solution to have an acidic pH. The pH is preferably in the range of from 2 to 7, more preferably in the range of from 2.2 to 6, and still more preferably in the range of from 2.4 to 5.

At the time of forming an aggregated particle, it is also effective to use an aggregating agent. As the aggregating agent, not only surfactants having a polarity reverse to that of the surfactant used for the dispersant and inorganic metal compounds but divalent or higher valent metal complexes are suitably useful. The case of using a metal complex is especially preferable because the use amount of the surfactant can be reduced, and the charge characteristic is enhanced.

Examples of the inorganic metal salt include metal salts such as calcium chloride, calcium nitrate, barium chloride, magnesium chloride, zinc chloride, aluminum chloride and aluminum sulfate; and inorganic metal salt polymers such as polyaluminum chloride, polyaluminum hydroxide and calcium polysulfide. Of these, an aluminum salt and a polymer thereof are especially suitable. In order to obtain a narrower particle size distribution, the valence of the inorganic metal salt is preferably divalence than monovalence, trivalence than divalence, and tetravalence than trivalence. Also, even when the valence is identical, an inorganic metal salt polymer of a polymerization type is more suitable.

Also, when the aggregated particle reaches a desired particle diameter, a toner matrix particle having a constitution in which the surface of a core aggregated particle is coated by the binder resin may be prepared by additionally adding the resin particle. In that case, the release agent or the crystalline polyester resin is hardly exposed on the toner matrix particle surface, and therefore, such is preferable from the viewpoints of chargeability and storage properties. In the case of additional addition, an aggregating agent may be added before the additional addition, or the pH may be adjusted.

[Fusing Step]

In the fusing step, the pH of the suspension liquid of the aggregated particle is raised to the range of from 4 to 8 under a stirring condition in conformity with the foregoing aggregating step to terminate the progress of aggregation, and heating is performed at a temperature of the glass transition temperature of the binder resin or higher, thereby fusing the aggregated particle. As an alkaline solution which is used for the purpose of raising the pH, an NaOH aqueous solution is preferable. As compared with other alkaline solutions, for example, an ammonia solution, the NaOH aqueous solution is low in volatility and high in safety. Also, as compared divalent alkaline solutions such as $Ca(OH)_2$, the NaOH aqueous solution is excellent in solubility in water, low in the necessary addition amount and excellent in aggregation terminating ability.

A heating time may be sufficient so far as it is a time to an extent that particle-to-particle fusion is achieved, and it is preferably from 0.5 hours to 10 hours. After fusion, the aggregated particle is cooled to obtain a fused particle. Also, the surface exposure may be suppressed by so-called quenching by increasing a cooling rate in the vicinity of the melting temperature (in the range of (melting temperature)±10° C.) of the release agent or binder resin in the cooling step, thereby suppressing recrystallization of the release agent or binder resin.

By performing the foregoing steps, the toner matrix particle as a fused particle is obtainable.

The toner matrix particle which is used in the present exemplary embodiment is also prepared by a kneading pulverization method.

In order to prepare the toner matrix particle by a kneading pulverization method, there is, for example, adopted a method in which a binder resin, a release agent, titanium oxide and the like are melt kneaded and dispersed by, for example, a pressure kneader, a roll mill, an extruder, etc., and after cooling, the dispersion is atomized by a jet mill or the like and classified by a classifier, for example, an air classifier, etc., thereby preparing a toner matrix particle with a desired particle diameter.

(2) Electrostatic Image Developer:

The electrostatic image developer according to the present exemplary embodiment is not particularly limited, except for the matter that it contains the toner according to the present exemplary embodiment, and it is able to take a proper component composition depending upon the purpose. In the present exemplary embodiment, it is preferable that the electrostatic image developer is prepared as an electrostatic image developer of a two-component system which is used in combination with a carrier.

(Carrier)

Examples of a core material of the carrier include magnetic metals (for example, iron, steel, nickel, cobalt, etc.) and alloys thereof with manganese, chromium, a rare earth or the like; and magnetic oxides (for example, ferrite, magnetite, etc.). From the viewpoints of core material surface properties and core material resistance, ferrite, especially an alloy thereof with manganese, lithium, strontium, magnesium, etc. is preferable.

The carrier which is used in the present exemplary embodiment is preferably one obtained by coating a resin on the core material surface. The resin is not particularly limited and is properly chosen depending upon the purpose. Examples thereof include resins which are known per se, such as polyolefin based resins (for example, polyethylene, polypropylene, etc.); polyvinyl based resins and polyvinylidene based resins (for example, polystyrene, acrylic resins, polyacrylonitrile, polyvinyl acetate, polyvinyl alcohol, polyvinyl butyral, polyvinyl chloride, polyvinylcarbazole, polyvinyl ether, polyvinyl ketone, etc.); a vinyl chloride-vinyl acetate copolymer; a styrene-acrylic acid copolymer; a straight silicone resin composed of an organosiloxane bond or modified products thereof; fluorocarbon based resins (for example, polytetrafluoroethylene, polyvinyl fluoride, polyvinylidene fluoride, polychlorotrifluoroethylene, etc.); silicone resins; polyesters; polyurethanes; polycarbonates; phenol resins; amino resins (for example, a urea-formaldehyde resin, a melamine resin, a benzoguanamine resin, a urea resin, a polyamide resin, etc.); and epoxy resins.

As for the coating made of the foregoing resin, it is preferable that a resin particle and/or a conductive particle is dispersed in the resin. Examples of the resin particle include a thermoplastic resin particle and a thermosetting resin particle. Of these, a thermosetting resin is preferable from the viewpoint that it is relatively easy to increase the hardness, and a resin particle composed of a nitrogen-containing resin containing an N atom is preferable from the viewpoint of imparting negative chargeability to the toner. Incidentally, these resin particles may be used singly or in combination of two or more kinds thereof. An average particle diameter of the resin particle is preferably from 0.1 μm to 2 μm or from about 0.1 μm to about 2 μm, and more preferably from 0.2 μm to 1 μm or from about 0.2 μm to about 1 μm. When the average particle diameter of the resin particle is 0.1 μm or more or about 0.1 μm or more, the dispersibility of the resin particle in the coating is excellent, whereas when the average particle diameter of the resin particle is 2 μm or less or about 2 μm or less, dropping of the resin particle from the coating hardly occurs.

Examples of the conductive particle include metal particles of gold, silver, copper or the like; carbon black particles; and particles obtained by coating the surface of a powder of titanium oxide, zinc oxide, barium sulfate, aluminum borate, potassium titanate or the like with tin oxide, carbon black, a metal or the like. These materials may be used singly or in combination of two or more kinds thereof. Of these, carbon black particles are preferable in view of the fact that manufacturing stability, costs, conductivity and so on are favorable. Though the kind of carbon black is not particularly limited, carbon black having a DBP oil absorption of from 50 mL/100 g to 250 mL/100 g is preferable because of its excellent manufacturing stability. A coating amount of each of the resin, the resin particle and the conductive particle on the core material surface is preferably from 0.5% by weight to 5.0% by weight, and more preferably from 0.7% by weight to 3.0% by weight.

Though a method for forming the coating is not particularly limited, examples thereof include a method using a coating film forming solution in which the resin particle and/or the conductive particle, and the resin such as a styrene-acrylic resin, a fluorocarbon based resin and a silicone resin as a matrix resin are contained in a solvent.

Specific examples thereof include an immersion method of immersing the carrier core material in the coating film forming solution; a spray method of spraying the coating film forming solution onto the surface of the carrier core material; and a kneader coater method of mixing the coating film forming solution and the carrier core material in a state where it is floated by flowing air and removing the solvent. Of these, the kneader coater method is preferable in the present exemplary embodiment.

The solvent which is used in the coating film forming solution is not particularly limited so far as it is able to dissolve only the resin that is a matrix resin. The solvent is chosen from solvents which are known per se, and examples thereof include aromatic hydrocarbons such as toluene and xylene, ketones such as acetone and methyl ethyl ketone, and ethers such as tetrahydrofuran and dioxane. In the case where the resin particle is dispersed in the coating, since the resin particle and the particle as a matrix resin are uniformly dispersed in the thickness direction thereof and in the tangential direction to the carrier surface, even when the carrier is used for a long period of time, whereby the coating is abraded, the surface formation which is similar to that of unused ones can be always kept. For that reason, a favorable ability of applying electrification to the toner can be kept over a long period of time. Also, in the case where the conductive particle is dispersed in the coating, since the conductive particle and the resin as a matrix resin are uniformly dispersed in the thickness direction thereof and in a tangential direction to the carrier surface, even when the carrier is used for a long period of time, whereby the coating is abraded, the surface formation which is similar to that of unused ones can be always kept, and deterioration of the carrier can be prevented from occurring over a long period of time. Incidentally, in the case where the resin particle and the conductive particle are dispersed in the coating, the foregoing effects can be exhibited at the same time.

An electrical resistance of the whole of the thus formed carrier in a magnetic brush state in an electric field of $10^4$ V/cm is preferably from $10^8$ Ωcm to $10^{13}$ Ωcm. When the electrical resistance of the carrier is $10^8$ Ωcm or more, adhesion of the carrier to an image area on the image holding member is suppressed, and a brush mark is hardly produced. On the other hand, where the electrical resistance of the carrier is $10^{13}$ Ωcm or less, the generation of an edge effect is suppressed, and a favorable image quality is obtainable.

Incidentally, a specific volume inherent resistance is measured as follows.

A sample is placed on a lower grid of a measuring jig that is a pair of 20-$cm^2$ circular grids (made of steel) connected to an electrometer (a trade name: KEITHLEY 610C, manufactured by Keithley Instruments Inc.) and a high-voltage power supply (a trade name: FLUKE 415B, manufactured by Fluke Corporation), so as to form a flat layer having a thickness of from 1 mm to 3 mm. Subsequently, after the sample is placed on the upper grid, in order to make a sample-to-sample space free, a weight of 4 kg is placed on the upper grid. A thickness of the sample layer is measured in this state. Subsequently, by impressing a voltage to the both grids, a current value is measured, and a specific volume resistance is calculated according to the following expression.

(Specific volume resistance)=(Impressed voltage)×20÷((Current value)−(Initial current value))÷(Sample thickness)

In the foregoing expression, the initial current value is a current value when the impressed voltage is 0; and the current value is a measured current value.

As for a mixing proportion of the toner according to the present exemplary embodiment to the carrier in the electrostatic image developer of a two-component system, the amount of the toner is preferably from 2 parts by weight to 10 parts by weight based on 100 parts by weight of the carrier.

Also, a preparation method of the developer is not particularly limited, and examples thereof include a method of mixing by a V-blender or the like.

(3) Image Forming Method:

Also, the electrostatic image developer (electrostatic image developing toner) is used for an image forming method of an electrostatic image development mode (electrophotographic mode).

The image forming method according to the present exemplary embodiment includes a charging step of charging an image holding member; a latent image forming step of forming an electrostatic latent image on the surface of the image holding member; a developing step of developing the electrostatic latent image formed on the surface of the image holding member with a developer containing a toner to form a toner image; a transferring step of transferring the toner image onto the surface of a transfer-receiving material; and a fixing step of fixing the toner image transferred onto the surface of the transfer-receiving material, wherein the electrostatic image developing toner according to the present exemplary embodiment or the electrostatic image developer according to the present exemplary embodiment is used as the developer.

The respective steps in the image forming method according to the present exemplary embodiment are a step which is known per se and are described in, for example, JP-A-56-40868, JP-A-49-91231 or the like.

The charging step is a step of charging an image holding member.

The latent image forming step is a step of forming an electrostatic latent image on the surface of the image holding member.

The developing step is a step of developing the electrostatic latent image formed on the surface of the image holding member with the electrostatic image developing toner according to the present exemplary embodiment or the electrostatic image developer containing the electrostatic image developing toner according to the present exemplary embodiment to form a toner image.

The transferring step is a step of transferring the toner image onto a transfer-receiving material.

The fixing step is a step of allowing the transfer-receiving material having the unfixed toner image formed thereon to pass between a heating member and a heating member to fix the toner image.

(4) Image Forming Apparatus:

The image forming apparatus according to the present exemplary embodiment includes an image holding member; a charging unit that charges the image holding member; an exposure unit that exposes the charged image holding member to form an electrostatic latent image on the surface of the image holding member; a developing unit that develops the electrostatic latent image with a developer containing a toner to form a toner image; a transfer unit that transfers the toner image from the image holding member onto the surface of a transfer-receiving material; and a fixing unit that fixes the transferred toner image on the surface of the transfer-receiving material, wherein the electrostatic image developing toner according to the present exemplary embodiment or the electrostatic image developer according to the present exemplary embodiment is used as the developer.

As for the image holding member and the respective units, the configurations mentioned in the respective steps of the foregoing image forming method are preferably used.

As for all of the foregoing respective units, units which are known in the image forming apparatus are utilized. Also, the image forming apparatus which is used in the present exemplary embodiment may be one including other units or apparatuses than the foregoing configurations. Also, in the image forming apparatus which is used in the present exemplary embodiment, a plurality of the foregoing units may be executed at the same time.

(5) Toner Cartridge and Process Cartridge:

A toner cartridge according to the present exemplary embodiment is detachable against the image forming apparatus and is characterized by accommodating at least the electrostatic image developing toner according to the present exemplary embodiment therein. The toner cartridge according to the present exemplary embodiment may store the electrostatic image developing toner according to the present exemplary embodiment as the electrostatic image developer.

Also, a process cartridge according to the present exemplary embodiment includes at least a developer holding member and is detachable against the image forming apparatus, and it is characterized by accommodating the electrostatic image developer according to the present exemplary embodiment therein. It is preferable that the process cartridge according to the present exemplary embodiment includes at least one member selected from the group consisting of a developing unit that develops an electrostatic latent image formed on the surface of an image holding member with the electrostatic image developing toner or the electrostatic image developer to form a toner image; an image holding member; a charging unit that charges the surface of the image holding member; and a cleaning unit that removes a toner remaining on the surface of the image holding member.

The toner cartridge according to the present exemplary embodiment is detachable against the image forming apparatus. In the image forming apparatus having such a configuration that a toner cartridge is detachable, the toner cartridge according to the present exemplary embodiment, which stores the toner according to the present exemplary embodiment, is suitably used.

Also, the toner cartridge may be a cartridge storing a toner and a carrier, and a cartridge storing a toner alone and a cartridge storing a carrier alone may be provided separately.

The process cartridge according to the present exemplary embodiment is detachable against the image forming apparatus.

Also, the process cartridge according to the present exemplary embodiment may include a destaticization unit or other member, if desired.

As for the toner cartridge and the process cartridge, known configurations may be adopted, and for example, JP-A-2008-209489, JP-A-2008-233736 or the like may be made herein by reference.

EXAMPLES

The present exemplary embodiments are hereunder described in detail while referring to the following Examples, but it should be construed that the present exemplary embodiments are not limited to these Examples at all. Incidentally, the terms "parts" and "%" in the following description express "parts by weight" and "% by weight", respectively unless otherwise indicated.

| <Synthesis of binder resin> - Amorphous polyester resin (1) - | |
|---|---|
| Bisphenol A ethylene oxide (EO): | 10 mol % |
| Bisphenol A propylene oxide (PO): | 90 mol % |

-continued

| <Synthesis of binder resin> - Amorphous polyester resin (1) - | |
|---|---|
| Terephthalic acid: | 10 mol % |
| Fumaric acid: | 40 mol % |
| Dodecenyl succinic acid (DSA): | 25 mol % |

The foregoing components are allowed to react with each other by heating at 240° C. for 6 hours to obtain an amorphous polyester resin (1). This amorphous polyester resin has a glass transition temperature Tg of 60° C. and a weight average molecular weight of 19,000.

<Preparation of Resin Particle Dispersion Liquid>

In a flask, 300 parts of the amorphous polyester resin (1) is weighed together with 96 parts of ethyl acetate and 96 parts of propanol, and the mixture is heated at 60° C. using a water bath (IWB-100, manufactured by AS One Corporation) and melted while stirring at a rotation number of 20 rpm by using a stirrer (BL600, manufactured by HEIDON). After completion of melting, 16.5 parts of a 10% ammonia aqueous solution is gradually dropped using a pipette; thereafter, 1,500 parts of ion-exchanged water is gradually dropped while keeping a dropping rate at from 7 g/min to 8 g/min using a peristaltic pump (MP-3N, manufactured by EYELA); and at the same time, stirring is continued by changing the stirring rate to 100 rpm.

After a lapse of 3 hours, when dropping of 700 parts of ion-exchanged water is completed, nitrogen is allowed to flow, thereby removing ethyl acetate in the resin dispersion liquid. After a lapse of one hour, when the removal of ethyl acetate is completed, the flask is taken off from the water bath and cooled at room temperature. When the resin dispersion liquid is cooled to room temperature, the contents are transferred into an eggplant type flask, and 2-propanol is removed while heating at 40° C. by a water bath (B-480, manufactured by SHIBATA) using an evaporator (Rotavapor R-114, manufactured by SHIBATA) and a vacuum controller (NVC-1100, manufactured by EYELA), thereby obtaining an amorphous polyester resin particle dispersion liquid having an average particle diameter of 110 nm.

<Preparation of Release Agent Dispersion Liquid>

Paraffin wax (manufactured by Nippon Seiro Co., Ltd.): 50 parts

Ionic surfactant (NEOGEN RK, manufactured by Dai-Ichi Kogyo Seiyaku Co., Ltd.): 1.0 part Ion-exchanged water: 200 parts The foregoing components are mixed and heated at 95° C., and the mixture is dispersed using a homogenizer (ULTRA-TURRAX T50, manufactured by IKA) and then subjected to a dispersing treatment for 5 hours by heating at 110° C. using a pressure discharge type Gaulin homogenizer (manufactured by Gaulin, Inc.), thereby preparing a release agent dispersion liquid having a volume average particle diameter of 200 nm and a solid content concentration of 20% by weight.

<Preparation of White Pigment Dispersion Liquid (1)>

To 100 mL of a 1 mol/L titanium tetrachloride aqueous solution, 0.15 mol of glycerin is added, and the mixture is heated at 90° C. for 3 hours, followed by filtration. The resulting white powder is dispersed in 100 mL of ion-exchanged water, to which is then added 0.4 mol of hydrochloride acid, and the mixture is again heated at 90° C. for 3 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by a transmission electron microscope (TEM), the resulting titanium oxide powder is titanium oxide having a volume average particle diameter of about 100 rim and a particle size distribution of 1.25 and is a porous material having pores of 3.5 rim, a BET specific surface area of 385 $m^2/g$ and an average circularity of 0.980.

There is thus obtained a porous titanium oxide (1).

Porous titanium oxide (1): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (1) (solid content concentration: 20% by weight).

<Preparation of White Pigment Dispersion Liquid (2)>

To 100 mL of a 1 mol/L titanium tetrachloride aqueous solution, 0.15 mol of glycerin is added, and the mixture is heated at 80° C. for 2 hours, followed by filtration. The resulting white powder is dispersed in 100 mL of ion-exchanged water, to which is then added 0.4 mol of hydrochloride acid, and the mixture is again heated at 80° C. for 2 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 10 nm and a particle size distribution of 1.25 and is a porous material having pores of 0.4 nm, a BET specific surface area of 385 $m^2/g$ and an average circularity of 0.980.

There is thus obtained a porous titanium oxide (2).

Porous titanium oxide (2): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (2) (solid content concentration: 20% by weight).

<Preparation of White Pigment Dispersion Liquid (3)>

To 100 mL of a 1 mol/L titanium tetrachloride aqueous solution, 0.15 mol of glycerin is added, and the mixture is heated at 95° C. for 4 hours, followed by filtration. The resulting white powder is dispersed in 100 mL of ion-exchanged water, to which is then added 0.4 mol of hydrochloride acid, and the mixture is again heated at 95° C. for 4 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 1,000 nm and a particle size distribution of 1.25 and is a porous material having pores of 30 nm, a BET specific surface area of 385 $m^2/g$ and an average circularity of 0.98.

There is thus obtained a porous titanium oxide (3).

Porous titanium oxide (3): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (3) (solid content concentration: 20% by weight).

<Preparation of White Pigment Dispersion Liquid (4)>

To 100 mL of a 1 mol/L titanium tetrachloride aqueous solution, 0.15 mol of glycerin is added, and the mixture is heated at 85° C. for 5 hours, followed by filtration. The resulting white powder is dispersed in 100 mL of ion-exchanged water, to which is then added 0.4 mol of hydrochloride acid, and the mixture is again heated at 80° C. for 5 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 250 $m^2/g$ and an average circularity of 0.980.

There is thus obtained a porous titanium oxide (4).

Porous titanium oxide (4): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (4) (solid content concentration: 20% by weight).

<Preparation of White Pigment Dispersion Liquid (5)>

To 100 mL of a 1 mol/L titanium tetrachloride aqueous solution, 0.15 mol of glycerin is added, and the mixture is heated at 90° C. for 2 hours, followed by filtration. The resulting white powder is dispersed in 100 mL of ion-exchanged water, to which is then added 0.4 mol of hydrochloride acid, and the mixture is again heated at 95° C. for 2 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 500 $m^2/g$ and an average circularity of 0.975.

There is thus obtained a porous titanium oxide (5).

Porous titanium oxide (5): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (5) (solid content concentration: 20% by weight).

<Preparation of White Pigment Dispersion Liquid (6)>

To 100 mL of a 1 mol/L titanium tetrachloride aqueous solution, 0.15 mol of glycerin is added, and the mixture is heated at 85° C. for 6 hours, followed by filtration. The resulting white powder is dispersed in 100 mL of ion-exchanged water, to which is then added 0.4 mol of hydrochloride acid, and the mixture is again heated at 90° C. for 5 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 50 nm and a particle size distribution of 1.10 and is a porous material having pores of 3.5 nm, a BET specific surface area of 250 $m^2/g$ and an average circularity of 0.985.

There is thus obtained a porous titanium oxide (6).

Porous titanium oxide (6): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (6) (solid content concentration: 20% by weight).

<Preparation of White Pigment Dispersion Liquid (7)>

To 100 mL of a 1 mol/L titanium tetrachloride aqueous solution, 0.15 mol of glycerin is added, and the mixture is heated at 90° C. for 3 hours, followed by filtration. The resulting white powder is dispersed in 100 mL of ion-exchanged water, to which is then added 1.0 mol of hydrochloride acid, and the mixture is again heated at 90° C. for 3 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 8% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 380 $m^2/g$ and an average circularity of 0.98.

There is thus obtained a porous titanium oxide (7).

Porous titanium oxide (7): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (7) (solid content concentration: 20% by weight).

<Preparation of White Pigment Dispersion Liquid (8)>

To 100 mL of a 1 mol/L titanium tetrachloride aqueous solution, 0.15 mol of glycerin is added, and the mixture is heated at 90° C. for 3 hours, followed by filtration. The resulting white powder is dispersed in 100 mL of ion-exchanged water, to which is then added 0.8 mol of hydrochloride acid, and the mixture is again heated at 90° C. for 3 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 10% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 380 $m^2/g$ and an average circularity of 0.980.

There is thus obtained a porous titanium oxide (8).

Porous titanium oxide (8): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (8) (solid content concentration: 20% by weight).

<Preparation of White Pigment Dispersion Liquid (9)>

To 100 mL of a 1 mol/L titanium tetrachloride aqueous solution, 0.15 mol of glycerin is added, and the mixture is heated at 90° C. for 3 hours, followed by filtration. The resulting white powder is dispersed in 100 mL of ion-exchanged water, to which is then added 0.3 mol of hydrochloride acid, and the mixture is again heated at 90° C. for 3 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 380 $m^2/g$ and an average circularity of 0.980.

There is thus obtained a porous titanium oxide (9).

Porous titanium oxide (9): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (9) (solid content concentration: 20% by weight).

<Preparation of White Pigment Dispersion Liquid (10)>

To 100 mL of a 1 mol/L titanium tetrachloride aqueous solution, 0.15 mol of glycerin is added, and the mixture is heated at 90° C. for 3 hours, followed by filtration. The resulting white powder is dispersed in 100 mL of ion-exchanged water, to which is then added 0.2 mol of hydrochloride acid, and the mixture is again heated at 90° C. for 3 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 55% by weight. Incidentally, the remaining crystal form is a rutile type. Also, as a result of observation by TEM, the resulting titanium oxide powder is titanium oxide having a volume average particle diameter of about 100 nm and a particle size distribution of 1.25 and is a porous material having pores of 3.5 nm, a BET specific surface area of 380 $m^2/g$ and an average circularity of 0.980.

There is thus obtained a porous titanium oxide (10).

Porous titanium oxide (10): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (10) (solid content concentration: 20% by weight).

<Preparation of White Pigment Dispersion Liquid (11)>

To 100 mL of a 1 mol/L titanium tetrachloride aqueous solution, 0.15 mol of glycerin is added, and the mixture is heated at 80° C. for 1.5 hours, followed by filtration. The resulting white powder is dispersed in 100 mL of ion-exchanged water, to which is then added 0.4 mol of hydrochloride acid, and the mixture is again heated at 75° C. for 2 hours. After adjusting the p1-1 at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 5 nm and a particle size distribution of 1.25 and is a porous material having pores of 0.2 nm, a BET specific surface area of 400 $m^2/g$ and an average circularity of 0.980.

There is thus obtained a porous titanium oxide (11).

Porous titanium oxide (11): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (11) (solid content concentration: 20% by weight).

<Preparation of White Pigment Dispersion Liquid (12)>

To 100 mL of a 1 mol/L titanium tetrachloride aqueous solution, 0.15 mol of glycerin is added, and the mixture is heated at 95° C. for 5 hours, followed by filtration. The resulting white powder is dispersed in 100 mL of ion-exchanged water, to which is then added 0.4 mol of hydrochloride acid, and the mixture is again heated at 90° C. for 6 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 1,500 nm and a particle size distribution of 1.25 and is a porous material having pores of 5 nm, a BET specific surface area of 400 $m^2/g$ and an average circularity of 0.980.

There is thus obtained a porous titanium oxide (12).

Porous titanium oxide (12): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (12) (solid content concentration: 20% by weight).

<Preparation of White Pigment Dispersion Liquid (13)>

To 100 mL of a 1 mol/L titanium tetrachloride aqueous solution, 0.15 mol of glycerin is added, and the mixture is heated at 80° C. for 6 hours, followed by filtration. The resulting white powder is dispersed in 100 mL of ion-exchanged water, to which is then added 0.4 mol of hydrochloride acid, and the mixture is again heated at 80° C. for 7 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 100 nm and a particle size distribution of 1.15 and is a porous material having pores of 3.5 nm, a BET specific surface area of 100 $m^2/g$ and an average circularity of 0.988.

There is thus obtained a porous titanium oxide (13).

Porous titanium oxide (13): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (13) (solid content concentration: 20% by weight).

<Preparation of White Pigment Dispersion Liquid (14)>

To 100 mL of a 1 mol/L titanium tetrachloride aqueous solution, 0.15 mol of glycerin is added, and the mixture is heated at 95° C. for 1.5 hours, followed by filtration. The resulting white powder is dispersed in 100 mL of ion-exchanged water, to which is then added 0.4 mol of hydrochloride acid, and the mixture is again heated at 90° C. for 2 hours. After adjusting the pH at 7 with sodium hydroxide, filtration, water washing and drying (at 105° C. for 12 hours) are performed to obtain a titanium oxide powder.

It is revealed by X-ray diffraction of the resulting titanium oxide powder that an anatase ratio of the crystal form is about 50% by weight. Incidentally, the remaining crystal form is a rutile type. Also, as a result of observation by TEM, the resulting titanium oxide powder is titanium oxide having a volume average particle diameter of about 100 nm and a particle size distribution of 1.40 and is a porous material having pores of 5 nm, a BET specific surface area of 800 $m^2/g$ and an average circularity of 0.972.

There is thus obtained a porous titanium oxide (14).

Porous titanium oxide (14): 60 parts

Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using ULTIMAIZER, thereby preparing a white pigment dispersion liquid (14) (solid content concentration: 20% by weight).

<Preparation of White Pigment Dispersion Liquid (15)>

Titanium oxide (rutile type, particle diameter: 100 nm, manufactured by Ishihara Sangyo Kaisha, Ltd.): 60 parts Nonionic surfactant (NONIPOL 400, manufactured by Sanyo Chemical Industries, Ltd.): 5 parts Ion-exchanged water: 240 parts The foregoing components are mixed, dissolved and stirred for 10 minutes using a homogenizer (ULTRA-TURRAX T50, manufactured by IKA), and thereafter, the resulting mixture is subjected to a dispersing treatment for 10 minutes using a high-pressure counter collision disperser, ULTIMAIZER (HJP30006, manufactured by Sugino Machine Limited), thereby preparing a white pigment dispersion liquid (15) (solid content concentration: 20% by weight) in which a rutile type titanium oxide (white pigment) having a volume average particle diameter of 100 nm is dispersed.

Example 1

<Preparation of Toner (1)>

Components according to the following composition of respective white toner particles (in the following composition of respective toner particles, all of solid content concentrations of the respective resin dispersion liquids are regulated to 25% by weight) are mixed in a round stainless steel-made flask and stirred at room temperature (25° C.) for 30 minutes. After completion of stirring, the resulting mixture is mixed and dispersed using a homogenizer (ULTRA-TURRAX T50, manufactured by IKA) while dropping 75 parts of a 10% ammonium sulfate aqueous solution (manufactured by Asada Chemical Industry Co., Ltd.) by using a pipette, and the contents in the flask are then heated to 45° C. while stirring, followed by keeping at 45° C. for 30 minutes.

As a result of observation of the resulting contents by an optical microscope, it is confirmed that an aggregated particle having a particle diameter of about 5.6 μm is produced. Here, 120 parts of the resin particle dispersion liquid is adjusted at a pH of 3 and then added to the foregoing aggregated particle dispersion liquid. Thereafter, the temperature of the resulting contents is gradually raised to 55° C. Subsequently, the resultant is adjusted at a pH of 8 with a sodium hydroxide aqueous solution, and thereafter, the temperature is raised to 90° C., followed by allowing the aggregated particle to coalesce over about one hour. After cooling, the coalesced particle is filtered, thoroughly washed with ion-exchanged water and then dried to obtain each of white toner particles.

Resin particle dispersion liquid: 680 parts

Release agent dispersion liquid: 100 parts

White pigment dispersion liquid (1): 264 parts

White pigment dispersion liquid (15): 66 parts

Examples 2 to 14 and Comparative Examples 1 to 8

Toners (2) to (22) are prepared in the same manner as in Example 1, except for changing the white pigment dispersion liquid to be used, or changing the total content of the white pigments contained in the toner, the content of the rutile type titanium oxide or the content of the porous titanium oxide as shown in Table 1.

(Evaluation)

DocuCentre Color 500 (manufactured by Fuji Xerox Co., Ltd.) is used for image outputting. The above-prepared toner is charged in a toner cartridge and a developing machine, thereby fabricating an image forming apparatus for evaluation.

Image outputting is performed, and OK Top Coat 127 gsm (manufactured by Oji Paper Co., Ltd.) is used as a base material on which an evaluation image is formed.

An image obtained by outputting a solid image with an amount of the toner per unit area of 1.0 $mg/cm^2$ (1.2 cm×17.0 cm in width; the outputting direction is a long side) is used as the evaluation image.

With respect to each of the toners, the resulting evaluation image is subjected to evaluation of whiteness (hiding power), exposure test, cracking test and evaluation of mottle, thereby evaluating each of the toners. The evaluation results are shown in Table 1.

<Evaluation of Whiteness (Hiding Power)>

The evaluation image placed on black solid paper is subjected to colorimetry with a spectrodensitometer X-rite 939 (manufactured by X-rite) and examined for a CIE1976 (L*a*b*) color system. The whiteness (hiding power) is evaluated according to the following criteria on the basis of an L* value of the CIE1976 (L*a*b*) color system.

A: The L* value is 95 or more.

B: The L* value is 85 or more and less than 95.

C: The L* value is 75 or more and less than 85.

D: The L* value is less than 75.

Incidentally, the CIE1976 (L*a*b*) color system is a color space recommended by CIE (Commission Internationale d'Eclairage) in 1976 and stipulated in JIS Z8729 of Japanese Industrial Standards.

<Exposure Test (Chalking)>

With respect to robustness of the image, the exposure test is performed in conformity with "General requirements for atmospheric exposure test" stipulated in JIS 22381 of Japanese Industrial Standards.

The exposure time is set to be 10 days, and a different ΔE between an image color difference before the exposure and an image color difference after the exposure is defined as follows.

$$\Delta E = (\text{Image color difference } E1 \text{ before the exposure}) - (\text{Image color difference } E2 \text{ after the exposure})$$

The larger the value of ΔE, the larger the discoloration by sunlight is, and thus, it may be considered that chalking is easily caused.

The evaluation criteria are as follows.

A: ΔE is less than 1.5.

B: ΔE is 1.5 or more and less than 3.

C: ΔE is 3 or more and less than 6.

D: ΔE is 6 or more.

<Cracking Test (Thickness of Cracked Wire)>

The cracking test is performed in conformity with "Testing method for paints—Mechanical property of film—Bending test (cylindrical mandrel)" stipulated in JIS K 5600-5-1 of Japanese Industrial Standards.

The evaluation criteria are as follows.

A: The thickness of the cracked wire is less than 0.3 mm.

B: The thickness of the cracked wire is 0.3 mm or more and less than 0.6 mm.

C: The thickness of the cracked wire is 0.6 mm or more and less than 1.0 mm.

D: The thickness of the cracked wire is 1.0 mm or more.

TABLE 1

| | Toner | White pigment dispersion liquid (containing porous titanium oxide) | White pigment dispersion liquid (containing rutile type titanium oxide) | Content of white pigment in toner: Total content of white pigments (% by weight) | Content of rutile type titanium oxide (% by weight) | Content of porous titanium oxide (% by weight) |
|---|---|---|---|---|---|---|
| Example 1 | Toner (1) | White pigment dispersion liquid (1) | White pigment dispersion liquid (15) | 30 | 24 | 6 |
| Example 2 | Toner (2) | White pigment dispersion liquid (1) | White pigment dispersion liquid (15) | 50 | 40 | 10 |
| Example 3 | Toner (3) | White pigment dispersion liquid (1) | White pigment dispersion liquid (15) | 5 | 4 | 1 |
| Example 4 | Toner (4) | White pigment dispersion liquid (1) | White pigment dispersion liquid (15) | 30 | 21 | 9 |
| Example 5 | Toner (5) | White pigment dispersion liquid (1) | White pigment dispersion liquid (15) | 30 | 27 | 3 |
| Example 6 | Toner (6) | White pigment dispersion liquid (2) | White pigment dispersion liquid (15) | 30 | 24 | 6 |
| Example 7 | Toner (7) | White pigment dispersion liquid (3) | White pigment dispersion liquid (15) | 30 | 24 | 6 |
| Example 8 | Toner (8) | White pigment dispersion liquid (6) | White pigment dispersion liquid (15) | 30 | 24 | 6 |
| Example 9 | Toner (9) | White pigment dispersion liquid (1)<br>White pigment dispersion liquid (3) | White pigment dispersion liquid (15) | 30 | 24 | 6 |
| Example 10 | Toner (10) | White pigment dispersion liquid (4) | White pigment dispersion liquid (15) | 30 | 24 | 6 |
| Example 11 | Toner (11) | White pigment dispersion liquid (5) | White pigment dispersion liquid (15) | 30 | 24 | 6 |
| Example 12 | Toner (12) | White pigment dispersion liquid (7) | White pigment dispersion liquid (15) | 30 | 24 | 6 |
| Example 13 | Toner (13) | White pigment dispersion liquid (8) | White pigment dispersion liquid (15) | 30 | 24 | 6 |
| Example 14 | Toner (14) | White pigment dispersion liquid (10) | White pigment dispersion liquid (15) | 30 | 24 | 6 |
| Comparative Example 1 | Toner (15) | White pigment dispersion liquid (1) | White pigment dispersion liquid (15) | 30 | 10 | 20 |
| Comparative Example 2 | Toner (16) | White pigment dispersion liquid (1) | White pigment dispersion liquid (15) | 30 | 29 | 1 |
| Comparative Example 3 | Toner (17) | White pigment dispersion liquid (11) | White pigment dispersion liquid (15) | 30 | 24 | 6 |
| Comparative Example 4 | Toner (18) | White pigment dispersion liquid (12) | White pigment dispersion liquid (15) | 30 | 24 | 6 |
| Comparative Example 5 | Toner (19) | White pigment dispersion liquid (13) | White pigment dispersion liquid (15) | 30 | 24 | 6 |
| Comparative Example 6 | Toner (20) | White pigment dispersion liquid (14) | White pigment dispersion liquid (15) | 30 | 24 | 6 |
| Comparative Example 7 | Toner (21) | White pigment dispersion liquid (1) | — | 30 | 0 | 30 |
| Comparative Example 8 | Toner (22) | — | White pigment dispersion liquid (15) | 30 | 30 | 0 |

| | Details of porous titanium oxide: Anatase ratio (% by weight) | Volume average particle diameter D50v (μm) | Particle size distribution GSDv | BET specific surface area ($m^2/g$) | Average circularity | Evaluation results: Whiteness (hiding power) | Chalking (ΔE) | Thickness of cracked wire (μm) |
|---|---|---|---|---|---|---|---|---|
| Example 1 | 50 | 0.1 | 1.25 | 385 | 0.98 | A: 98 | A: 0.6 | A: 0.1 |
| Example 2 | 50 | 0.1 | 1.25 | 385 | 0.98 | A: 96 | A: 0.8 | C: 0.8 |
| Example 3 | 50 | 0.1 | 1.25 | 385 | 0.98 | C: 82 | B: 2.8 | A: 0.2 |
| Example 4 | 50 | 0.1 | 1.25 | 385 | 0.98 | A: 96 | C: 3.3 | A: 0.2 |
| Example 5 | 50 | 0.1 | 1.25 | 385 | 0.98 | A: 99 | C: 3.6 | A: 0.2 |
| Example 6 | 50 | 0.01 | 1.25 | 385 | 0.98 | B: 85 | B: 1.5 | A: 0.2 |
| Example 7 | 50 | 1 | 1.25 | 385 | 0.98 | B: 88 | B: 2.7 | A: 0.2 |
| Example 8 | 50 | 0.05 | 1.1 | 250 | 0.985 | C: 83 | B: 2.1 | A: 0.2 |
| Example 9 | 50 | 0.75 | 1.3 | 400 | 0.98 | A: 96 | B: 2.0 | B: 0.4 |
| Example 10 | 50 | 0.1 | 1.25 | 250 | 0.98 | C: 84 | A: 1.4 | A: 0.2 |
| Example 11 | 50 | 0.1 | 1.25 | 500 | 0.975 | C: 83 | A: 1.2 | A: 0.2 |
| Example 12 | 8 | 0.1 | 1.25 | 380 | 0.98 | A: 96 | C: 5.2 | B: 0.5 |
| Example 13 | 10 | 0.1 | 1.25 | 380 | 0.98 | A: 96 | B: 2.7 | B: 0.3 |
| Example 14 | 55 | 0.1 | 1.25 | 380 | 0.98 | A: 98 | B: 2.1 | B: 0.3 |
| Comparative Example 1 | 50 | 0.1 | 1.25 | 385 | 0.98 | B: 85 | D: 6.2 | A: 0.2 |
| Comparative Example 2 | 50 | 0.1 | 1.25 | 385 | 0.98 | B: 86 | D: 6.5 | A: 0.2 |
| Comparative Example 3 | 50 | 0.005 | 1.25 | 400 | 0.98 | D: 74 | C: 3.2 | A: 0.2 |
| Comparative Example 4 | 50 | 1.5 | 1.25 | 400 | 0.98 | D: 72 | C: 3.2 | A: 0.2 |
| Comparative Example 5 | 50 | 0.1 | 1.15 | 100 | 0.988 | D: 73 | C: 3.3 | A: 0.2 |
| Comparative Example 6 | 50 | 0.1 | 1.4 | 800 | 0.972 | D: 72 | C: 4.5 | A: 0.2 |
| Comparative Example 7 | 50 | 0.1 | 1.25 | 385 | 0.98 | B: 86 | A: 0.6 | D: 2.5 |
| Comparative Example 8 | 5 to 85 | 0.1 to 0.5 | 1.1 to 1.3 | 200 to 500 | 0.97 to 0.99 | C: 80 | D: 6.0 | B: 0.3 |

What is claimed is:

1. An electrostatic image developing toner comprising:

a binder resin and at least two different kinds of white pigments, wherein from about 10% by weight to about 30% by weight of the at least two kinds of white pigments is porous titanium oxide having a volume average particle diameter of from about 0.01 μm to about 1 μm, a particle size distribution (volume average particle size distribution index GSDv) of from about 1.1 to about 1.3 and a BET specific surface area of from about 250 $m^2/g$ to about 500 $m^2/g$.

2. The electrostatic image developing toner according to claim 1, wherein an average circularity of the porous titanium oxide is more than about 0.970 and less than about 0.990.

3. The electrostatic image developing toner according to claim 1, wherein the porous titanium oxide is formed by aggregating a titanium oxide particle having a volume average particle diameter of from about 0.001 μm to about 0.05 μm.

4. The electrostatic image developing toner according to claim 1, wherein from about 10% by weight to about 50% by weight of the porous titanium oxide has an anatase type crystal structure.

5. The electrostatic image developing toner according to claim 1, wherein the at least two kinds of white pigments contains rutile type titanium oxide having a rutile type crystal structure.

6. The electrostatic image developing toner according to claim 1, wherein a total content of the at least two kinds of white pigments is from about 5% by weight to about 50% by weight relative to the whole weight of the toner.

7. The electrostatic image developing toner according to claim 1, wherein a glass transition temperature of the binder resin is from about 50° C. to about 75° C.

8. The electrostatic image developing toner according to claim 1, wherein a weight average molecular weight of the binder resin is from about 8,000 to about 150,000.

9. The electrostatic image developing toner according to claim 1, wherein an acid number of the binder resin is from about 5 mg-KOH/g to about 30 mg-KOH/g.

10. The electrostatic image developing toner according to claim 1, wherein the binder resin is a polyester resin.

11. The electrostatic image developing toner according to claim 10, wherein about 80% by mol or more of a polycarboxylic acid-derived component constituting the polyester resin is an aliphatic dicarboxylic acid.

12. The electrostatic image developing toner according to claim 10, wherein about 80% by mol or more of a polyol-derived component constituting the polyester resin is an aliphatic polyol.

13. The electrostatic image developing toner according to claim 1, wherein the toner contains a release agent which is melted at any temperature of from about 70° C. to about 140° C. and has a melt viscosity of from about 1 centipoise to about 200 centipoises.

14. The electrostatic image developing toner according to claim 1, having a volume average particle size distribution index GSDv of about 1.30 or less.

15. The electrostatic image developing toner according to claim 1, having a shape constant SF1 (=((absolute maximum length of toner diameter)$^2$/(projected area of toner))×(π/4)×100) of from about 110 to about 160.

16. An electrostatic image developer comprising the electrostatic image developing toner according to claim 1 and a carrier.

17. The electrostatic image developer according to claim 16, wherein the carrier is a resin-coated carrier, and a resin particle and/or a conductive particle is dispersed in the resin-coated resin.

18. The electrostatic image developer according to claim 17, wherein an average particle diameter of the resin particle is from about 0.1 μm to about 2 μm.

19. The electrostatic image developer according to claim 17, wherein the conductive particle is carbon black.

20. A toner cartridge which is detachable against an image forming apparatus and accommodates the electrostatic image developing toner according to claim 1.

21. A process cartridge which includes a developer holding member, is detachable against an image forming apparatus and accommodates the electrostatic image developer according to claim 16.

22. An image forming method comprising:

charging an image holding member;

forming an electrostatic latent image on the surface of the image holding member;

developing the electrostatic latent image formed on the surface of the image holding member with a developer containing a toner to form a toner image;

transferring the toner image onto the surface of a transfer-receiving material; and fixing the toner image transferred onto the surface of the transfer-receiving material, wherein the electrostatic image developer according to claim 16 is used as the developer.

23. An image forming apparatus comprising:

an image holding member;

a charging unit that charges the image holding member;

an exposure unit that exposes the charged image holding member to form an electrostatic latent image on the surface of the image holding member;

a developing unit that develops the electrostatic latent image with a developer containing a toner to form a toner image;

a transfer unit that transfers the toner image from the image holding member onto the surface of a transfer-receiving material; and a fixing unit that fixes the transferred toner image on the surface of the transfer-receiving material, wherein the electrostatic image developer according to claim 16 is used as the developer.

* * * * *